United States Patent [19]

Garwood et al.

[11] Patent Number: 4,975,177

[45] **Date of Patent: * Dec. 4, 1990**

[54] HIGH VISCOSITY INDEX LUBRICANTS

[75] Inventors: William E. Garwood, Haddonfield; Quang N. Le, Cherry Hill; Stephen S. Wong, Medford, all of N.J.

[73] Assignee: Mobil Oil Corporation, New York, N.Y.

[ * ] Notice: The portion of the term of this patent subsequent to Apr. 24, 2007 has been disclaimed.

[21] Appl. No.: 382,077

[22] Filed: Jul. 17, 1989

Related U.S. Application Data

[63] Continuation of Ser. No. 44,187, Apr. 30, 1987, abandoned, which is a continuation-in-part of Ser. No. 793,937, Nov. 1, 1985, abandoned.

[51] Int. Cl.[5] ..... C10G 65/12

[52] U.S. Cl. ..... 208/27; 208/18; 208/49; 208/58; 208/59; 208/96; 208/97; 585/739

[58] Field of Search ..... 208/49, 59, 89, 18, 208/58, 27, 97, 96; 585/739

[56] References Cited

U.S. PATENT DOCUMENTS

| | | | |
|---|---|---|---|
| 3,385,781 | 5/1968 | Hamner et al. | 208/59 |
| 3,630,885 | 12/1971 | Egan | 208/59 |
| 3,684,691 | 8/1972 | Arey et al. | 208/59 |
| 3,915,843 | 10/1975 | Franck et al. | 208/59 |
| 4,222,855 | 9/1980 | Pelrine et al. | 208/111 |
| 4,229,282 | 10/1980 | Peters et al. | 208/59 |
| 4,259,174 | 3/1981 | Chen et al. | 208/57 |
| 4,372,839 | 2/1983 | Oleck et al. | 208/59 |
| 4,419,220 | 12/1983 | LaPierre et al. | 585/739 |
| 4,428,819 | 1/1984 | Shu et al. | 208/111 |
| 4,518,485 | 5/1985 | LaPierre et al. | 585/739 |
| 4,554,065 | 11/1985 | Albinson et al. | 585/739 |
| 4,594,172 | 6/1986 | Sie | 252/55 |
| 4,599,162 | 7/1986 | Yen | 208/59 |
| 4,601,993 | 7/1986 | Chu et al. | 208/111 |

FOREIGN PATENT DOCUMENTS

| | | | |
|---|---|---|---|
| 1390359 | 4/1975 | United Kingdom | 208/18 |
| 1429494 | 3/1976 | United Kingdom | 208/18 |

OTHER PUBLICATIONS

"Lube Oil Manufacture by Severe Hydrotreatment", S. Bull et al, pp. 221–PD 19(2).

*Primary Examiner*—Anthony McFarlane
*Attorney, Agent, or Firm*—Alexander J. McKillop; Charles J. Speciale; Malcolm D. Keen

[57] ABSTRACT

Lubricant basestocks of high viscosity index, typically with V.I. of at least 130 or higher, and low pour point, typically below 5° F., are produced by hydroisomerizing petroleum waxes such as slack wax or de-oiled wax, over zeolite beta and then dewaxing to target pour point. A preferred process employs a solvent dewaxing after the hydroisomerization step to effect a partial dewaxing with the separated waxes being recycled to the hydroisomerization step; dewaxing is then completed catalytically, typically over ZSM-5 or ZSM-23.

20 Claims, 6 Drawing Sheets

HIGH VISCOSITY INDEX LUBRICANTS

This is a continuation of copending application Ser. No. 044,187, filed on Apr. 30, 1987 (now abandoned), which is a continuation of 793,937, Nov. 1, 1985, abandoned.

FIELD OF THE INVENTION

The present invention relates to lubricants of mineral oil origin which are characterized by high viscosity indices, low pour points and other desirable properties and which may be produced in good yields from readily available refinery streams.

REFERENCE TO RELATED APPLICATIONS

The present lubricants may be made by a process of the type described in Ser. No. 793,937 and accordingly, the entire contents of the specification of Ser. No. 793,937 are incorporated in this application by this reference to it.

BACKGROUND OF THE INVENTION

Mineral oil lubricants are derived from various crude oil stocks by a variety of refining processes. Generally, these refining processes are directed towards obtaining a lubricant base stock of suitable boiling point, viscosity, viscosity index (VI) and other characteristics. Generally, the base stock will be produced from the crude oil by distillation of the crude in atmospheric and vacuum distillation towers, followed by the separation of undesirable aromatic components and finally, by dewaxing and various finishing steps. Because aromatic components lead to high viscosity and extremely poor viscosity indices, the use of asphaltic type crudes is not preferred as the yield of acceptable lube stocks will be extremely low after the large quantities of aromatic components contained in such crudes have been separated out; paraffinic and naphthenic crude stocks will therefore be preferred but aromatic separation procedures will still be necessary in order to remove undesirable aromatic components. In the case of the lubricant distillate fractions, generally referred to as the neutrals, e.g. heavy neutral, light neutral, etc., the aromatics will be extracted by solvent extraction using a solvent such as Sulfolane, Udex or another material which is selective for the extraction of the aromatic components. If the lube stock is a residual lube stock, the asphaltenes will first be removed in a propane deasphalting step followed by solvent extraction of residual aromatics to produce a lube generally referred to as bright stock. In either case, however, a dewaxing step is normally necessary in order for the lubricant to have a satisfactorily low pour point and cloud point, so that it will not solidify or precipitate the less soluble paraffinic components under the influence of low temperatures.

A number of dewaxing processes are known in the petroleum refining industry and of these, solvent dewaxing with solvents such as methylethylketone (MEK) and liquid propane, has been the one which has achieved the widest use in the industry. Recently, however, proposals have been made for using catalytic dewaxing processes for the production of lubricating oil stocks and these processes possess a number of advantages over the conventional solvent dewaxing procedures. The catalytic dewaxing processes which have been proposed are generally similar to those which have been proposed for dewaxing the middle distillate fractions such as heating oils, jet fuels and kerosenes, of which a number have been disclosed in the literature, for example, in Oil and Gas Journal, Jan. 6, 1975, pp. 69–73 and U.S. Pat. Nos. RE 28,398, 3,956,102 and 4,100,056. At least one of these processes, the Mobil Lube Oil Dewaxing Process (MLDW) has now reached maturity and is capable of producing low pour point oils not attainable by solvent dewaxing. See 1986 Refining Process Handbook, Gulf Publishing Co., (September 1986 Hydrocarbon Processing), page 90.

Generally, these catalytic dewaxing processes operate by selectively cracking the longer chain end paraffins to produce lower molecular weight products which may then be removed by distillation from the higher boiling lube stock. The catalysts which have been proposed for this purpose have usually been zeolites which have a pore size which admits the straight chain, waxy n-paraffins either alone or with only slightly branched chain paraffins but which exclude more highly branched materials and cycloaliphatics. Zeolites such as ZSM-5, ZSM-11, ZSM-12, ZSM-22, ZSM-23, ZSM-35 and ZSM-38 have been proposed for this purpose in dewaxing processes, as described in U.S. Pat. Nos. 3,894,938, 4,176,050, 4,181,598, 4,222,855, 4,229,282 and 4,247,388. A dewaxing process employing synthetic offretite is described in U.S. Pat. No. 4,259,174. The relationship between zeolite structure and dewaxing properties is discussed in J. Catalysis 86, 24–31 (1984).

Although the catalytic dewaxing processes are commercially attractive because they do not produce quantities of solid paraffin wax which presently is regarded as an undesirable, low value product, they do have certain disadvantages and because of this, certain proposals have been made for combining the catalytic dewaxing processes with other processes in order to produce lube stocks of satisfactory properties. For example, U.S. Pat. No. 4,181,598 discloses a method for producing a high quality lube base stock by subjecting a waxy fraction to solvent refining, followed by catalytic dewaxing over ZSM-5 with subsequent hydrotreatment of the product. U.S. Pat. No. 4,428,819 discloses a process for improving the quality of catalytically dewaxed lube stocks by subjecting the catalytically dewaxed oil to a hydroisomerization process which removes residual quantities of petrolatum wax which contribute to poor performance in the Overnight Cloud Point test (ASTM D2500-66).

As mentioned above, the conventional catalytic dewaxing processes using intermediate pore size zeolites such as ZSM-5 operate by selectively cracking the waxy components of the feed. This results in a loss in yield since the components which are in the desired boiling range undergo a bulk conversion to lower boiling fractions which, although they may be useful in other products, must be removed from the lube stock. A notable advance in dewaxing process is described in U.S. Pat. Nos. 4,419,220 and 4,518,485, in which the waxy components of the feed, comprising straight chain and slightly branched chain paraffins, are removed by isomerization over a catalyst based on zeolite beta. During the isomerization, the waxy components are converted to relatively less waxy isoparaffins and at the same time, the slightly branched chain paraffins undergo isomerization to more highly branched aliphatics. A measure of cracking does take place during the operation so that not only is the pour point reduced by reason of the isomerization but, in addition, the heavy ends undergo some cracking or hydrocracking to form liquid range materials which contribute to a low viscosity product. The degree of cracking is, however, limited so as to maintain as much of the feedstock as possible in the desired boiling range. As mentioned above, this process uses a catalyst which is based on zeolite beta, together with a suitable hydrogenation-dehydrogenation component which is typically a base metal or a noble metal, usually of group VIA or VIIIA of the Periodic Table of the Elements (the periodic table used in this specification is the table approved by IUPAC), such as cobalt, molybdenum, nickel, tungsten, palladium or platinum. As described in U.S. Pat. No. 4,518,485, the isomerization dewaxing step may be proceded by a hydrotreating step in order to remove heteroatom-containing impurities, which may be separated in an interstage separation process similar to that employed in two-stage hydrotreating-hydrocracking processes.

As is apparent from the preceding description, the objective in dewaxing processes is to remove the waxy components of the feed which tend to precipitate out of the liquid oil when it is subjected to low temperatures. These waxy components may generally be characterized as the straight chain and slightly branched chain paraffins of high melting point, especially the mono-methyl paraffins. Generally, the straight chain paraffins must be removed in order to ensure that the oil has a satisfactorily low pour point while the slightly branched chain materials need to be removed in order to ensure that the product does not become hazy by the relatively slow growth of the waxy components. If especially low pour points are desired, it may be necessary to remove some of the higher melting point branched chain paraffins such as the mono-methyl paraffins because preferential removal of the n-paraffins will generally lower the pour point to about −18° C. (−28° F.). A countervailing factor, however, is that it is generally undesirable to operate the dewaxing under conditions of relatively high severity because not only does this result in a lower lube yield but, in addition, the isoparaffinic components which contribute to a high viscosity index may be removed together with the waxy components which are more straight chain in character. Thus, a balance must be sought between removing sufficient of the waxy paraffins to obtain the desired pour point and cloud point specifications and the need to retain a sufficient number of the branched chain isoparaffins which contribute to a good viscosity index (VI) in the product. It is, of course, desirable to produce a base stock of high V.I. since this reduces the need for V.I. improvers which, besides being expensive, become degraded in use with a resultant deterioration in lubricant properties. The objective of the dewaxing procedure must therefore be to produce a lube stock with an acceptable balance of properties in as high a yield as possible.

With the present trend to more severe service ratings, there is a need to develop better lubricants. For example, the SAE service ratings of SD and SE are becoming obsolescent as more engine manufacturers specify an SF rating and it is expected that even more severe ratings will need to be met in the future as engine core temperatures increase in the movement toward greater engine efficiency. This progressive increase in service severity is manifested by improved resistance to oxidation at high temperatures and by higher V.I. requirements to ensure that the lubricants will have adequate viscosity at high temperatures without excessive viscosity when the engine is cold.

Because of their highly paraffinic nature, the waxes produced during conventional solvent dewaxing processes have been considered for use as lubestocks. Being highly paraffinic they have excellent V.I. but their high melting point generally precludes their use as automotive lubricants. Attempts have, however, been made to use them after suitable processing. The article by Bull in Developments in Lubrication PD 19(2), 221–228 describes a process which subjects slack wax from a solvent (MEK-toluene) dewaxing unit to severe hydrotreating in a blocked operation together with other base stocks to produce high viscosity index (HVI) base oils. The promise of the process does not, however, appear to have been fully realized in practice since high V.I. oils of low pour point have not become commercially available. U.S. Pat. No. 4,547,283 describes a process for hydroisomerizing petroleum waxes such as slack wax using a specific type of catalyst treated with certain reactive metal compounds such as tetramethyl ammonium aluminate. Although high V.I. values are reported for the hydroisomerized wax products it is by no means clear that low pour points have been secured and accordingly it seem that the objective of matching low pour point with high V.I. in a lubricant of mineral oil origin has still to be met. A related proposal to use Foots Oil (the mixed oil/wax product of de-oiling slack wax) as a lube feedstock by dewaxing it over an intermediate pore size zeolite such as ZSM-5 is made in U.S. Pat. No. 3,960,705 but the products had relatively high pour points and the reported V.I. values do not exceed 107.

In application Ser. No. 793,937 a process for producing high V.I., low pour point lubes from various paraffinic feeds such as slack wax or waxy gas oils such as the South East Asian gas oils is described. The process employs a first step in which a partial catalytic dewaxing is carried out with a zeolitic dewaxing catalyst which converts the waxy paraffin components is less waxy, high V.I. iso-paraffins. A subsequent, highly selective catalytic dewaxing is carried out using a highly shape selective dewaxing catalyst such as ZSM-23.

SUMMARY OF THE INVENTION

It has now been found that lubricant products of extremely high quality may be produced by a process of the type described in application Ser. No. 793,937, using petroleum waxes as the feed. According to the present invention, the lubricant products are characterized by high viscosity index (V.I.), low pour point (ASTM D-97) and retain their fluidity at low temperatures. These lubricants have a minimum V.I. of 130 and in most cases even higher values may be readily attained. Typical V.I. values are at least 140 and may even exceed 150 e.g., 155. The low temperature properties of the oils are outstanding: pour point (ASTM D-97) is no higher than 5° F. (−5° C.) and is typically below 0° F. (about −18° C.) and the Brookfield viscosity is less than 2500 P. at −20° F. (about −29° C.) for the basestock, i.e., additive-free stock. As manifested by the excellent high V.I., the relationship between temperature and viscosity is characterized by a relatively low decrease in viscosity with increasing temperature: at 40° C., viscosity is typically no higher than 25 cSt. while at 100° C. it is no less than 5.0 cSt and usually is higher e.g., 5.3 cSt.

These lubricants may be produced from petroleum waxes by a process of sequential hydroisomerization and hydrodewaxing as described in Ser. No. 793,937, followed by hydrotreating to remove residual aromatics and to stabilize the dewaxed product. Alternatively, the wax may first be deoiled to remove aromatics and the deoiled wax subjected to the hydroisomerization-hydrodewaxing sequence of Ser. No. 793,937 to produce the final lube base stock. The former process (HI-HDW-HDT) sequence is preferred since it gives higher yields and does not require the expensive deoiling step; the second process may, however, be employed if there is sufficient solvent dewaxing capacity available for the de-oiling step or if no adequate hydrotreating capacity is available.

DETAILED DESCRIPTION

Feedstock

Figure 1:
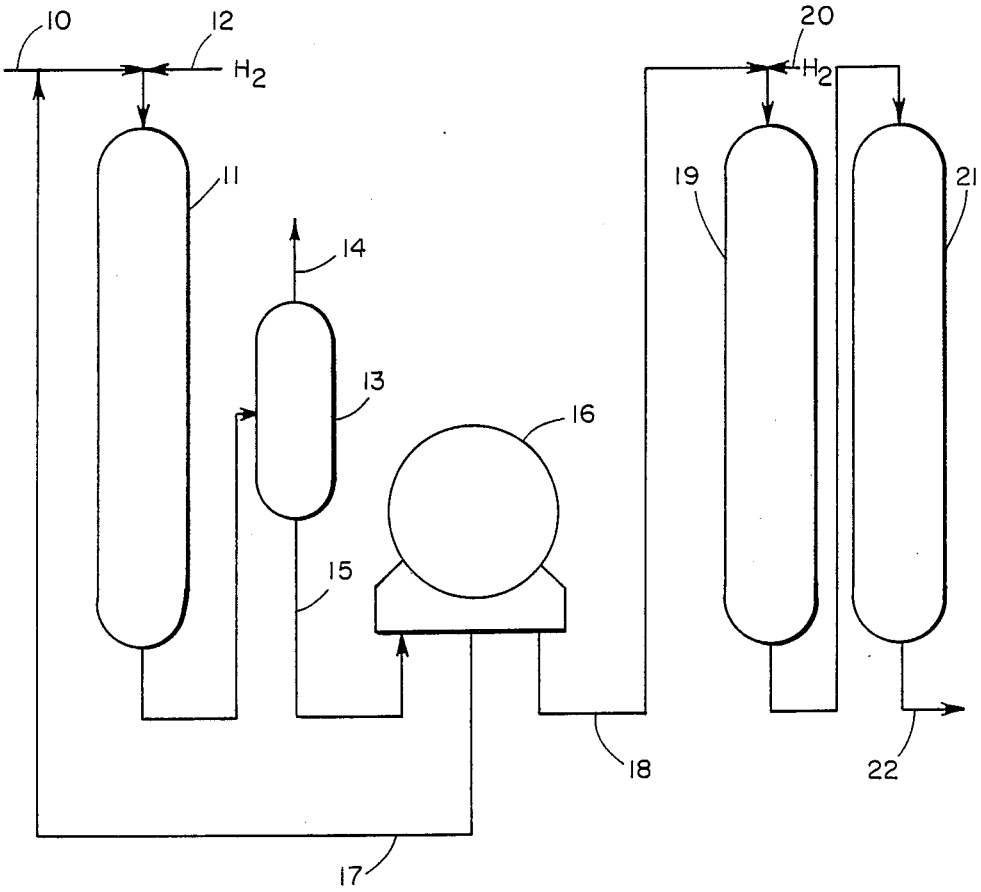

The starting materials used to make the present lube products are petroleum waxes, that is, waxes of paraffinic character derived from the refining of petroleum and other liquids by physical separation from a wax-containing refinery stream, usually by chilling the stream to a temperature at which the wax separates, usually by solvent dewaxing, e.g., MEK/toluene dewaxing or an autorefrigerant process such as propane dewaxing. Although the waxes will generally be derived from mineral oils other sources may be used, especially shale oil and synthetic production methods, especially Fischer-Tropsch synthesis which produces highly paraffinic waxes in the high boiling fractions. These waxes have high initial boiling points above about 650° F. (about 345° C.) which render them extremely useful for processing into lubricants which also require an initial boiling point of at least 650° F. (about 345° C.). The presence of lower boiling components is not to be excluded since they will be moved together with higher products produced during the processing during the separation steps which follow the characteristic processing steps. Since these components will reduce the final lube yield and, in addition, will load up the process units they are preferably excluded by suitable choice of feed cut point. The end point of the wax feed will usually be not more than about 1050° F. (about 565° C.) so that they may be classified as distillate rather than residual streams.

The paraffin content of the wax feed is high, generally at least 50, more usually at least 70, weight percent with the balance from occluded oil being divided between aromatics and naphthenics. These waxy, highly paraffinic stocks usually have much lower viscosities than neutral or residual lube stocks because of their relatively low content of aromatics and naphthenes which are high viscosity components. The high content of waxy paraffins, however, gives them melting points and pour points which render them unacceptable as lubricants without further processing.

The wax may suitably be a slack wax, that is, the waxy product obtained directly from a solvent dewaxing process, e.g. an MEK or propane dewaxing process. The slack wax, which is a solid to semi-solid product, comprising mostly highly waxy paraffins (mostly n- and mono-methyl paraffins) together with occluded oil, may be used as such or it may be subjected to an initial deoiling step of a conventional character in order to remove the occluded oil so as to form a harder, more highly paraffinic wax which may then be passed to the hydrocracker. The oil which is removed during the de-oiling step is conventionally and rather curiously known as Foots Oil. The Foots Oil contains most of the aromatics present in the original slack wax and with these aromatics, most of the heteroatoms. Typically, Foots Oil contains 30–40 percent aromatics. The deoiling step is desirable, therefore, because it removes the undesirable aromatics and heteroatoms which would otherwise increase hydrogen consumption and catalyst aging during the hydrocracking or, alternatively, would degrade the final lubricant quality if they passed through the hydrocracker.

The compositions of some typical waxes are given in Table 1 below.

TABLE 1

| Wax Composition - Arab Light Crude | A | B | C | D |
|---|---|---|---|---|
| Paraffins, wt. pct. | 94.2 | 81.8 | 70.5 | 51.4 |
| Mono-naphthenes, wt. pct. | 2.6 | 11.0 | 6.3 | 16.5 |
| Poly-naphthenes, wt. pct. | 2.2 | 3.2 | 7.9 | 9.9 |
| Aromatics, wt. pct. | 1.0 | 4.0 | 15.3 | 22.2 |

It is preferred that the content of non-paraffins should be kept as low as possible both in order to improve the final lube yield and to obtain the best combination of lube properties. For this reason, a de-oiling step may be desired when dealing with slack waxes with relatively high levels of occluded oil.

Because the feeds are highly paraffinic, the heteroatom content is low and accordingly the feed may be passed directly into the first characteristic process step, the first stage dewaxing hydroisomerization over the zeolite beta catalyst.

First Stage Dewaxing

In this step, the wax feed is subjected to catalytic dewaxing by isomerization over a zeolite beta based catalyst. Although isomerization does not require hydrogen for stoichiometric balance, the presence of hydrogen is desirable in order to promote certain steps in the isomerization mechanism and also to maintain catalyst activity (for this reason, this step of the process is also referred to as a hydroisomerization step). Also, because the isomerization steps entail hydrogenation and dehydrogenation, the catalyst will desirably contain a hydrogenation-dehydrogenation component in addition to the zeolite. The hydrogenation-dehydrogenation component (referred to, for convenience, as a hydrogenation component) is generally a metal or metals of groups IB, IVA, VA, VIA, VIIA or VIIIA of the Periodic Table, preferably of Groups VIA or VIIIA and may be either a base metal such as cobalt, nickel, vanadium, tungsten, titanium or molybdenum or a noble metal such as platinum, rhenium, palladium or gold. Combinations of base metals such as cobalt-nickel, cobalt-molybdenum, nickel-tungsten, cobalt-nickel-tungsten or cobalt-nickel-titanium may often be used to advantage and combinations or noble metals such as platinum-palladium may also be used, as may combinations of base metals with noble metals, such as platinum-nickel. Because the present feeds have a low heteroatom content, the use of noble metals is possible and platinum is the metal component of choice. These metal components may be incorporated into the catalyst by conventional methods such as impregnation using salts of the metals or solutions of soluble complexes which may be cationic, anionic or neutral in type. The amount of the hydrogenation component is typically from 0.01 to 10% by weight of catalyst with the more highly active noble metals being used at lower concentrations, typically from 0.1 to 1% whereas the base metals are normally present in relatively higher concentrations, e.g. 1 to 10%.

Because the feeds used to make the present lubes are highly paraffinic in nature, zeolite beta is used as the acidic component of the catalyst. Zeolite beta is highly effective for the isomerization of waxy paraffins to relatively less waxy, high V.I. iso-paraffins and it has the additional advantage that it maintains this activity even in the presence of aromatics. This enables the zeolite beta to effect a partial dewaxing of the wax feed by reducing the content of waxy paraffins (n- and slightly branched chain paraffins) while, at the same time, increasing the content of the iso-paraffins which will give the final lubricant a high V.I. as well as a low pour point. So, in the first stage of the process, the objective is to effect removal of the straight chain n-paraffins while minimizing the removal of the branched chain isoparaffins. However, because the feed may contain a number of isomeric paraffins in the same boiling range, some of which are straight chain, some of which are slightly branched chain (with short chain branches) and some of which are more highly branched, it is not possible to carry out the removal in a completely selective manner. Because of this, some of the less highly branched isoparaffins will be removed together with the n-paraffins and conversely, some of the n-paraffins will remain in the feed until it is subjected to the subsequent, selective dewaxing step in which the n-paraffins are removed. However, because the zeolite beta catalyst initially removes the n-paraffins in preference to the isoparaffins, the content of isoparaffins in the feed will initially increase as a result both of the selective removal of the n-paraffins as well as of the production of iso-paraffins by isomerization.

Initially, the catalyst isomerizes the n-paraffins to iso-paraffins, so reducing the content of the former and increasing that of the latter, both on an absolute and relative basis. At more extended contact times (increased severity) the catalyst will, however, convert the iso-paraffins as well as the n-paraffins so that both decrease together, although at slightly different rates. In order to achieve the highest V.I. in the product, the conditions in the first dewaxing step are chosen to maximize the concentration of iso-paraffins in the product; however, this may not enable the target pour point for the catalytic dewaxing operation to be achieved and so it may be necessary to reduce the content of iso-paraffins below this maximum figure even though this may result in some loss of V.I. in the product. It may be possible to maximize V.I. in the product by operating the first dewaxing step under optimum conditions so as to maximize the iso-paraffin content of the catalytically dewaxed effluent, with the balance of the waxy paraffins being removed in the subsequent selective dewaxing step but this will depend upon the product specifications, the exact composition of the feed, the dewaxing capacity of the second dewaxing step, the amount of wax by-product which is acceptable and the extent to which it is possible to optimize conditions in the first catalytic dewaxing step.

Zeolite beta is a known zeolite which is described in U.S. Pat. Nos. 3,308,069 and RE 28,341, to which reference is made for further details of this zeolite, its preparation and properties. The preferred forms of zeolite beta for use in the present process are the high silica forms, having a silica alumina ratio of at least 30:1 and it has been found that ratios of at least 50:1 or even higher, for example, 100:1, 250:1, 500:1, may be used to advantage because these forms of the zeolite are less active for cracking than the less highly siliceous forms so that the desired isomerization reactions are favored at the expense of cracking reactions which tend to effect a bulk conversion of the feed, forming cracked products which are outside the desired boiling range for lube components. Suitable catalysts for use in the present process are described in U.S. Pat. Nos. 4,419,220 and 4,518,485, to which reference is made for a more detailed description of these zeolite beta based catalysts. As mentioned in these two patents, the silica: alumina ratios referred to in this specification are the structural or framework ratios and the zeolite, whatever its type, may be incorporated into a matrix material such as clay, silica or a metal oxide such as alumina or silica-alumina.

The zeolite beta catalyst acts by isomerizing the long chain waxy paraffins in the feed to form iso-paraffins which are less waxy in nature but which possess a notably high viscosity index. At the same time, the zeolite will promote a certain degree of cracking or hydrocracking so that some conversion to products outside the lube boiling range will take place. This is not, however, totally undesirable if significant quantities of aromatics are present in the feed since they will then tend to be removed by hydrocracking, with consequent improvements in the viscosity and V.I. of the product. The extent to which cracking reactions and isomerization reactions will predominate will depend on a number of factors, principally the acidity of the zeolite the severity of the reaction (temperature, contact time) and the composition of the feedstock. In general, cracking will be favored over isomerization at higher severities (higher temperature, longer contact time) and with more highly acidic zeolites. Thus, higher silica: alumina ratio in the zeolite will generally favor isomerization and therefore will normally be preferred, except possibly to handle more highly aromatic feeds. The acidity of the zeolite may also be controlled by exchange with alkali metal cations, especially sodium, in order to control the extent to which isomerization occurs relative to cracking. The extent to which isomerization will be favored over cracking will also depend upon the total conversion, itself a factor dependent upon severity. At high conversions isomerization may decrease fairly rapidly at the expense of cracking reactions. Because the present feeds are highly paraffinic it is usually not necessary to go to high levels of conversion: generally conversion will be not more than 50 volume percent per pass and in most cases will be lower, for example, not more than 25 to 35 volume percent to 650° F.− (345° C.−) products.

The exact conditions selected will depend not only on the character of the feed but also on the properties desired in the final lube product.

For example, with wax feeds with a significant aromatic content, it may be desirable to promote hydrocracking so as to remove the aromatics even at the expense of the resulting yield loss which will ensue, both by aromatics hydrocracking but also by the more or less inevitable paraffin cracking which will accompany it. The effect of catalyst choice and reaction conditions will be generally as described in Ser. No. 793,937, namely, that the more highly acidic zeolites and higher reaction severities will tend to promote hydrocracking reactions over isomerization and that total conversion and choice of hydrogen-dehydrogenation component will also play their parts. Because these will interact in divers ways to affect the result, it is possible here to give no more than this broad indication of what type of result may be obtained from any given selection among the available variables.

Generally, the conditions employed in this step of the process may be described as being of elevated temperature and pressure. Temperatures are normally from 250° C. to 500° C. (about 480° to 930° F.), preferably 370° to 430° C. (about 700° to 800° F.) but temperatures as low as 200° C. may be used for these highly paraffinic feedstocks. Because the use of lower temperatures tends to favor the desired isomerization reactions over the cracking reactions, the lower temperatures will generally be preferred although it should be remembered that since the degree of cracking which will to some extent inevitably take place will be dependent upon severity, a balance may be established between reaction temperature and average residence time in order to achieve an adequate rate of isomerization while minimizing cracking. Pressures may range up to high values, e.g. up to 25,000 kPa (3,600 psig), more usually in the range 2,000 to 10,000 kPa (275 to 1,435 psig), hydrogen partial pressure at reactor inlet. Space velocity (LHSV) is generally in the range of 0.1 to 5 $hr.^{-1}$, more usually 0.2 to 5 $hr.^{-1}$. The hydrogen:feed ratio is generally from 50 to 1,000 $n.l.l.^{-1}$ (about 280 to 5617 SCF/bbl), preferably 200 to 400 $n.l.l.^{-1}$ (about 1125 to 2250 SCF/Bbl). Net hydrogen consumption will depend upon the course of the reaction, increasing with increasing hydrocracking and decreasing as isomerization (which is hydrogen-balanced) predominates. The net hydrogen consumption will typically be under about 40 $n.l.l.^{-1}$ (about 224 SCF/Bbl) with the present feeds of relatively low aromatic content such as the slack wax and frequently will be less, typically below 35 $n.l.l.^{-1}$ (about 197 SCF/Bbl). Process configuration will be as described in U.S. Pat. Nos. 4,419,220 and 4,518,485, i.e. with downflow trickle bed operation being preferred.

Selection of the severity of the dewaxing operation is an important part of the present process because, as mentioned above, it is not possible to remove the straight chain and slightly branched chain waxy components in a completely selective manner, while retaining the desirable more highly branch chain components which contribute to high V.I. in the product. For this reason, the degree of dewaxing which is achieved in the first step, is limited so as to leave a residual quantity of waxy components which are then removed in the second selective dewaxing step. The objective of maximizing the isoparaffinic content of the effluent from the catalytic dewaxing step so as to obtain the highest V.I. in the final product may be achieved by adjusting the severity of the initial dewaxing operation until the optimum conditions are reached for this objective. As the contact time between the catalyst and the feed is extended, the catalyst will effect some cracking besides the desired paraffin isomerization reactions so that the iso-paraffins which are formed by the isomerization reactions as well as the isoparaffins originally present in the feed will become subjected to conversion as the contact time becomes longer. Thus, once catalyst type and temperature are selected, the most significant variable in the process from the point of view of producing the products with the best balance of qualities is the contact time between the feed and the catalyst, relative to catalytic activity. Again, because the catalyst will age as the process continues, the optimum contact time will need to be varied itself as a function of increasing operational duration. As a general guide, the contact time (1/LHSV) under typical conditions will generally be less than 0.5 hours in order to maximize the isoparaffinic content of the catalytically dewaxed effluent. However, if lower pour points are desired, longer contact times, typically up to one hour may be employed and in cases where an extreme reduction in pour point is desired, up to two hours.

Although the process is best characterized in terms of the effects which are achieved at each step, practical considerations may dictate that somewhat less than optimum conditions be used in order to minimize analytical work. As a general guide, the minimum amount of dewaxing which occurs during the initial dewaxing step should be such that the pour point of the catalytically dewaxed effluent is reduced by at least 10° F. (5.5° C.) and preferably by at least 20° F. (11° C.). The maximum amount of dewaxing in the initial dewaxing step should be such that the pour point of the first stage effluent is not lower than 10° F. (5.5° C.), preferably 20° F. (11° C.), above the target pour point for the desired product. This range of partial dewaxing by isomerization will generally be found to maximize isoparaffin production so as to produce a product of low pour point with a high V.I. However, these figures are given as a general guide and naturally, if wax feeds of extremely high pour point are used, or if the target pour point for the product is extremely low, it may be necessary or desirable to depart from these approximate figures. Generally, many feeds will have pour points in the range of about 25° to 90° C. (about 75° to 195° F.) unless, like slack wax, they are solid at ambient temperatures. Product pour points are generally in the range −5° to −55° C. (about 23° to −67° F.) and it is therefore usually possible to carry out the dewaxing steps within the limits set out above. Pour point of 10° to 20° F. for the intermediate, partly dewaxed product are preferred.

The effluent from the first stage dewaxing step may be subjected to fractionation to separate lower boiling fractions out of the lube boiling range, usually 345° C.− (about 650° F.), before passing the intermediate product to the second stage, selective dewaxing. Removal of the lower boiling products, together with any inorganic nitrogen and sulfur formed in the first stage is preferred in order to facilitate control of the pour point of the second stage product if solvent dewaxing is used.

Selective Dewaxing

The effluent from the initial catalytic dewaxing step still contains quantities of the more waxy straight chain, n-paraffins, together with the higher melting non-normal paraffins. Because these contribute to unfavorable pour points, and because the effluent will have a pour point which is above the target pour point for the product, it is necessary to remove these waxy components. To do this without removing the desirable isoparaffinic components which contribute to high V.I. in the product, a selective dewaxing step is carried out. This step removes the n-paraffins together with the more highly waxy, slightly branched chain paraffins, while leaving the more branched chain iso-paraffins in the process stream. Conventional solvent dewaxing processes may be used for this purpose because they are highly selective for the removal of the more waxy components including the n-paraffins and slightly branched chain paraffins, as may catalytic dewaxing processes which are more highly selective for removal of n-paraffins and slightly branched chain paraffins. This step of the process is therefore carried out as described in Ser. No. 793,937, to which reference is made for a description of this step. As disclosed there, solvent dewaxing may be used or catalytic dewaxing and if catalytic dewaxing is employed, it is preferably with a selectivity greater than that of ZSM-5. Thus, catalytic dewaxing with a highly shape selective dewaxing catalyst based on a zeolite with a constraint index of at least 8 is preferred with ZSM-23 being the preferred zeolite, although other highly shape-selective zeolites such as the synthetic ferrierite ZSM-35 may also be used, especially with lighter stocks. Typical dewaxing processes of this type are described in the following U.S. Pat. Nos.: 3,700,585 (Re 28,398), 3,894,938, 3,933,974, 4,176,050, 4,181,598, 4,222,855, 4,259,170, 4,229,282, 4,251,499, 4,343,692 and 4,247,388.

The dewaxing catalyst used in the catalytic dewaxing will normally include a metal hydrogenation-dehydrogenation component of the type described above; even though it may not be strictly necessary to promote the selective cracking reactions, its presence may be desirable to promote certain isomerization mechanisms which are involved in the cracking sequence, and for similar reasons, the dewaxing is normally carried out in the presence of hydrogen, under pressure. The use of the metal function also helps retard catalyst aging in the presence of hydrogen and, may also increase the stability of the product. The metal will usually be of the type described above, i.e. a metal of Groups IB, IVA, VA, VIA, VIIA or VIIIA, preferably of Groups VIA or VIIIA, including base metals such as nickel, cobalt, molybdenum, tungsten and noble metals, especially platinum or palladium. The amount of the metal component will typically be 0.1 to 10 percent by weight, as described above and matrix materials and binders may be employed as necessary.

Shape selective dewaxing using the highly constrained, highly shaped-selective catalysts zeolite may be carried out in the same general manner as other catalytic dewaxing processes, for example, in the same general manner and with similar conditions as those described above for the initial catalytic dewaxing step. Thus, conditions will generally be of elevated temperature and pressure with hydrogen, typically at temperatures from 250° to 500° C. (about 480° F. to 930° F.), more usually 300° to 450° C. (about 570° F. to 840° F.) and in most cases not higher than about 370° C. (about 700° F.), pressures up to 25,000 kPa, more usually up to 10,000 kPa, space velocities of 0.1 to 10 $hr^{-1}$ (LHSV), more usually 0.2 to 5 $hr^{-1}$, with hydrogen circulation rates of 500 to 1000 $n.l.l.^{-1}$, more usually 200 to 400 $n.l.l.^{-1}$. Reference is made to Ser. No. 793,937 for a more extended discussion of the catalytic dewaxing step.

If solvent dewaxing is used, the wax by-product from the solvent dewaxing may be recycled to the process to increase the total lube yield. If necessary, the recycled slack wax by-product may be de-oiled to remove aromatics concentrated in the oil fraction and residual heteroatom-containing impurities. Use of the solvent dewaxing with recycle of the wax to the hydroisomerization step provides a highly efficient process which is capable of providing yield lube yields. Based on the original wax feed, the yield following the hydroisomerization-solvent dewaxing sequence is typically at least 50 volume percent and usually at least 60 volume percent or even higher, for instance, 65 volume percent, of high V.I., low pour point lube. Solvent dewaxing may be used in combination with catalytic dewaxing, with an initial solvent dewaxing followed by catalytic dewaxing to the desired final pour point and recycle of the separated wax from the solvent process.

Hydrotreating

Depending upon the quantity of residual aromatics in the dewaxed lube product it may be desirable to carry out a final hydrotreatment in order to remove at least some of these aromatics and to stabilize the product. The quantity of aromatics at this stage will depend on the nature of the feed and, of course, on the processing conditions employed. If a de-oiled wax feed is used so that the aromatics are removed at the outset in the de-oiling step, the final hydrotreatment will generally be unnecessary. Similarly, if the aromatics are sufficiently removed during the first partial dewaxing step, the hydrotreatment may also be unnecessary but because removal of aromatics at that stage will generally imply higher severity operation with increased paraffin cracking and a significant yield loss, it will generally be preferred to separate the aromatics in the subsequent hydrotreating step when the catalyst will be relatively non-acidic so that cracking will be reduced.

Conventional hydrotreating catalysts and conditions are suitably used. Catalysts typically comprise a base metal hydrogenation component such as nickel, tungsten, cobalt, nickel-tungsten, nickel-molybdenum or cobalt-molybdenum, on an inorganic oxide support of low acidity such as silica, alumina or silica-alumina, generally of a large pore, amorphous character. Typical hydrotreating conditions use moderate temperatures and pressures, e.g. 290°–425° C. (about 550°–800° F.), typically 345°–400° C. (about 650°–750° F.), up to 20,000 kPa (about 3000 psig), typically about 4250–14000 kPa (about 600–2000 psig) hydrogen pressure. Because aromatics separation is desired relatively high pressures above 7000 kPa (about 1000 psig) are favored, typically 10,000–14,000 kPa (about 1435–2000 psig). Space velocities of about 0.3–2.0, typically 1 LHSV, with hydrogen circulation rates typically about 600–1000 $n.l.l.^{-1}$ (about 107 to 5617 SCF/Bbl) usually about 700 $n.l.l.^{-1}$ (about 3930 SCF/Bbl). The severity of the hydrotreating step should be selected according to the characteristics of the feed and of the product. The objectives is to reduce residual aromatic content by saturation to form naphthenes so as to make initial improvements in lube quality by removal of aromatics and formation of naphthenes, as well as to improve the color and oxidative stability of the final lube product. It may, however, be desirable to leave some aromatics in the final lube base stock to improve solvency for certain lube additives. Conversion to products outside the lube boiling range, i.e. to 650° F.− (about 345° C.−) products, will typically be no more than 10 volume percent and in most cases not more than 5 volume percent.

Process Configuration

Generally, the hydroisomerization and dewaxing steps will be operated as described above with a selective catalytic dewaxing step following the hydroisomerization. A particularly useful process configuration for a wax feed is shown, however, in FIG. 1, using a combination of solvent and catalytic dewaxing steps for improved yield at low pour points. In the hydroisomerization/dewaxing unit shown in FIG. 1, a wax feed such as slack wax or deoiled wax is introduced through inlet 10 into hydroisomerization reactor 11 in which it undergoes the characteristic isomerization reactions over a zeolite-beta based hydroisomerization catalyst, e.g., Pt/beta or Pd/beta. Hydrogen is fed in also through inlet 12 from the hydrogen circuit (not shown). The partly dewaxed, hydroisomerized effluent then passes to a product separator 13 in which hydrogen and light ends separated from the lube boiling range product are removed through outlet 14. The lube fraction passes through conduit 15 to solvent dewaxing unit 16, suitably an MEK/toluene dewaxer or propane dewaxing unit, where the intermediate pour point of the hydroisomerized product is reduced further by a physical separation of the more highly waxy components which remain after the hydroisomerization step. The separated waxes are removed from unit 16 through wax recycle line 17 which returns them to inlet 10 of hydroisomerization reactor 12 for another pass through the reactor where isomerization to less waxy iso-paraffins may take place. The partly dewaxed lube product at a second intermediate pour point then passes through lube outlet line 18 to catalytic dewaxing reactor 19 where it is dewaxed over a shape-selective dewaxing catalyst such as ZSM-5 or ZSM-23 as described above. Hydrogen enters through inlet line 20 from the hydrogen circuit. From dewaxing reactor 19, the dewaxed product at its final pour point is then cascaded to hydrotreating reactor 21 for stabilization by removal of lube boiling range olefins, removal of aromatics and color bodies. The stabilized, dewaxed lube at its final pour point then leaves the hydrotreating reactor through outlet 22 to proceed to a product fractionator (not shown) for removal of light ends.

In a unit of this kind, the overall yield is maximized by the physical separation and recycle of the waxier components in the solvent unit with dewaxing to very low final pour points following in the catalytic dewaxing unit. Typically, the unit will be operated to achieve a partial dewaxing by hydroisomerization in the first step but with no attempt to obtain a particularly low pour point. In fact, at this stage, intermediate product pour points of about 15° C. (about 60° F.) or higher, e.g., 25° C. (about 77° F.) or 40° C. (about 100° F.) are acceptable since the objective of the isomerization step is simply to boost the proportion of iso-paraffins in the intermediate product. After passing through the solvent unit, pour point is reduced typically to −20° to 0° C. (about −4° to 32° F.) more usually −17° to −10° C. (about 0° to +14° F.), with the separated waxes recycled to the hydroisomerization unit. Target pour point is attained after passing through the catalytic dewaxing unit, typically not higher than −12° C. (about 10° F.) and usually below about −15° C. (5° F.). Very low pour points below −25° C. (about −31° F.), e.g., −40° C./F., may be obtained at high product yields in this way. Low Brookfield viscosities, e.g., below 2500 p. at −20° F. (about −29° C.) may be attained.

Products

The dewaxed lubricant products of the present process are characterized by a high viscosity index coupled with a low pour point. Viscosity indices of at least 130, e.g., 140 or 150 are characteristic of the highly paraffinic nature of the products but with low pour points indicating a significant quantity of iso-paraffinic components. Pour points below 10° F. for the basestock (i.e., without pour point improvers or other additives) and in most cases below 5° F. are readily attained, e.g., °F. with correspondingly low Brookfield viscosities, e.g., less than 2500 p. at −20° F. Thus, the present lubricant basestocks have an extremely good combination of properties making them highly suitable for formulation into finished lubricants with additives such as pour point improvers (to effect further pour point reductions), antioxidants, anti-wear agents and extreme pressure agents.

EXAMPLES 1-3

The effect of the selective dewaxing step was demonstrated by dewaxing a commercially available, high viscosity index lubricant (VI=147, pour point=+10F.) over Ni ZSM-5 and Pt ZSM-23 dewaxing catalysts. This lubestock is representative of a high viscosity, highly paraffinic product with an unacceptably high point in the additive-free condition.

The catalysts which were used were as follows:

Ex. 1 1 Wt % Ni/ZSM-5

This catalyst had an approximate alpha of 90 and was sulfided in situ at 400° C. (750° F.) before introduction of oil.

Ex. 2 1 Wt % Pt/ZSM-23

The ZSM-23 was crystallized at 170° C. (340° F.), and the platinum put on by impregnation of the extrudate with chloroplatinic acid.

Ex. 3 0.5 Wt % Pt/ZSM-23

The zeolite was crystallized at 143° C. (290° F.), and the platinum put on by exchange of the extrudate with Pt tetraamine chloride. Both Pt catalysts were reduced with hydrogen at 480° C. (900° F.) for 1 hour before introduction of oil.

Figure 3:
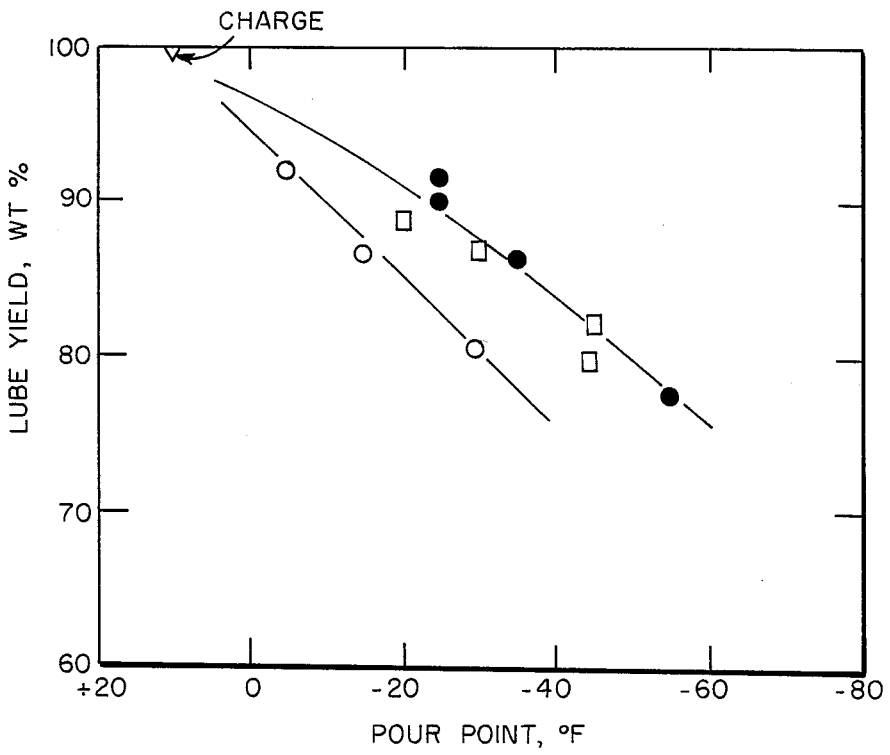
Figure 4:
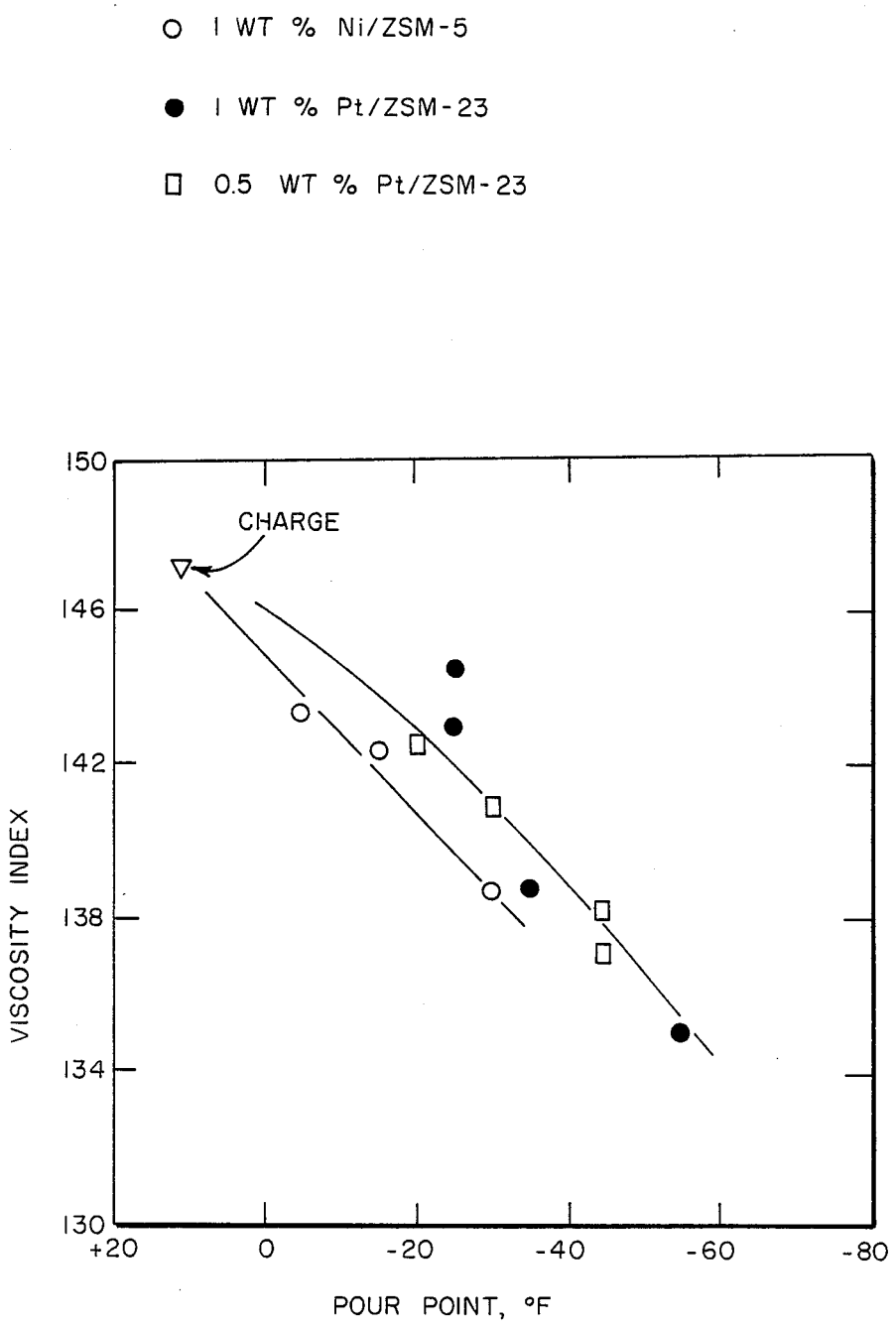

The feed was passed over the dewaxing catalysts at temperatures from about 230° C. (450° F.) to 330° C. (625° F.) at 2860 kPa abs. (400 psig) $H_2$ pressure, 1 LHSV, 445 n.l.l.$^{-1}$ $H_2$:oil (2500 SCF/Bbl). The results are shown in attached FIGS. 2, 3 and 4.

Figure 2:
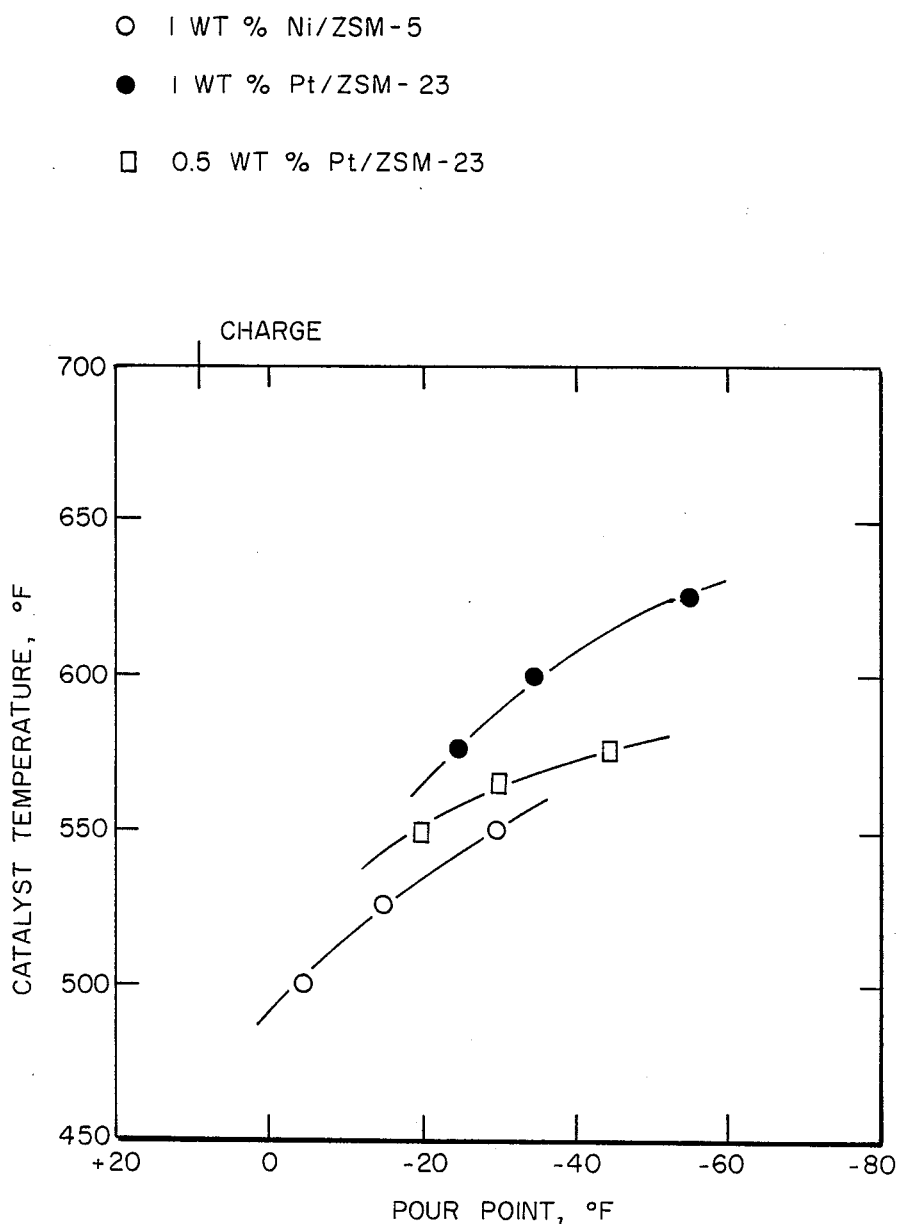

FIG. 2 shows that the Ni/ZSM-5 catalyst is the most active. The 0.5% Pt/ZSM-23 catalyst is about 14° C. (25° F.) more active than the 1% Pt catalyst at −34° C. (−30° F.) pour point and about 11° C. (20° F.) less active than the NiZSM-5 catalyst. The two Pt/ZSM-23 catalysts give essentially the same yield and VI at a given pour point (FIGS. 3, 4) and both are higher than those using Ni/ZSM-5. At −34° C. (−30°F.) pour point, yield and VI are 87 and 141, respectively for the Pt/ZSM-23 catalysts compared to 81 and 139 for the Ni/ZSM-5 catalyst.

The properties of the products obtained during two material balances with the Ni/ZSM-5 and 0.5% Pt/ZSM-23 catalysts are shown in Table 2 below.

TABLE 2

| | Lube Dewaxing | | |
|---|---|---|---|
| Ex. No. | | 1-1 | 3-1 |
| Catalyst | Charge | Ni/ZSM-5 | 0.5% Pt/ZSM-23 |
| Av. Cat. Temp °C. (°F.) | | 290 (550) | 296 (565) |
| Liquid Product | | | |
| Pour Point, °C. (°F.) | | −37 (−35) | −34 (−30) |
| H, Wt % | 14.86 | 15.32 | 15.22 |
| Yields, Wt % (NLB) | | | |
| $C_1 + C_2$ | | 0.3 | 0.1 |
| $C_3$ | | 3.2 | 1.7 |
| $C_4$ | | 5.2 | 2.9 |
| $C_5$ | | 3.9 | 2.6 |
| $C_6$-650° F. | | 10.7 | 7.0 |
| 650° F.+ | | 80.5 | 86.2 |

TABLE 2-continued

| Ex. No. Catalyst | Lube Dewaxing Charge | 1-1 Ni/ZSM-5 | 3-1 0.5% Pt/ ZSM-23 |
|---|---|---|---|
| $H_2$ Cons., SCF/bbl | | 390 | 285 |
| Lube Properties | | | |
| Gravity, °API | 39.5 | 39.2 | 39.5 |
| Specific | 0.8275 | 0.8289 | 0.8275 |
| Pour Point, °C. (°F.) (D-97) | +10 | −34 (−30) | −34 (−30) |
| K.V. @ 40° C., cs. | 26.37 | 27.91 | 27.57 |
| K.V. @ 100° C., cs. | 5.45 | 5.51 | 5.50 |
| SUS @ 100° F. | 136 | 143 | 142 |
| SUS @ 210° F. | 44.5 | 44.7 | 44.7 |
| Viscosity Index | 147 | 138.7 | 140.9 |
| Paraffins, Wt % | 73 | — | 77 |
| Naphthenes, Wt % | 25 | — | 20 |
| Aromatics, Wt % | 2 | 4.3 | 3 |
| Performance, | | | |
| Formulated (1) Pour Point, °F. | −15 | — | — |
| Brookfield Vis, P | | | |
| @ 0° F. | 8.1 | 8.4 | 7.4 |
| @ −20° F. | — | 24.5 | 24.6 |
| RBOT, min | 245 | 185 | 245 |

Notes:
(1) Formulated for hydraulic oil with commercial additive package.
(2) RBOT result is from −20° C. (−5° F.) pour product.

EXAMPLES 4–5

These Examples illustrate the preparation of a low pour point, high VI lube from a slack wax feed.

The slack wax feed had the properties shown in Table 3 below.

TABLE 3

| Slack Wax | |
|---|---|
| Gravity, API | 35.8 |
| Gravity, specific at 21° C. (70° F.) | 0.8458 |
| Oil content, wt % | 17.0 |
| Melting point, °C. (°F.) | 65 (150) |
| K.V. at 100° C., cS+ | 8.515 |

The slack wax was then hydroisomerized over a 0.6 wt pct Pt/zeolite beta dewaxing catalyst at two different severity levels to give two stocks with pour points of over 120° F. and 90° F. respectively. The hydroisomerization was conducted at 2860 kPa (400 psig) hydrogen pressure, 1 LHSV, 222 n.l.l.$^{-1}$ (1250 SCF/Bbl) hydrogen:oil with catalyst temperatures of approximately 396° C. (745° F.) and 404° C. (760° F.) to give the two respective products. The yields of 345° C.+ (650° F.+) lube products were 78 wt. percent and 55 wt. percent, respectively, at the two temperatures.

Figure 5:
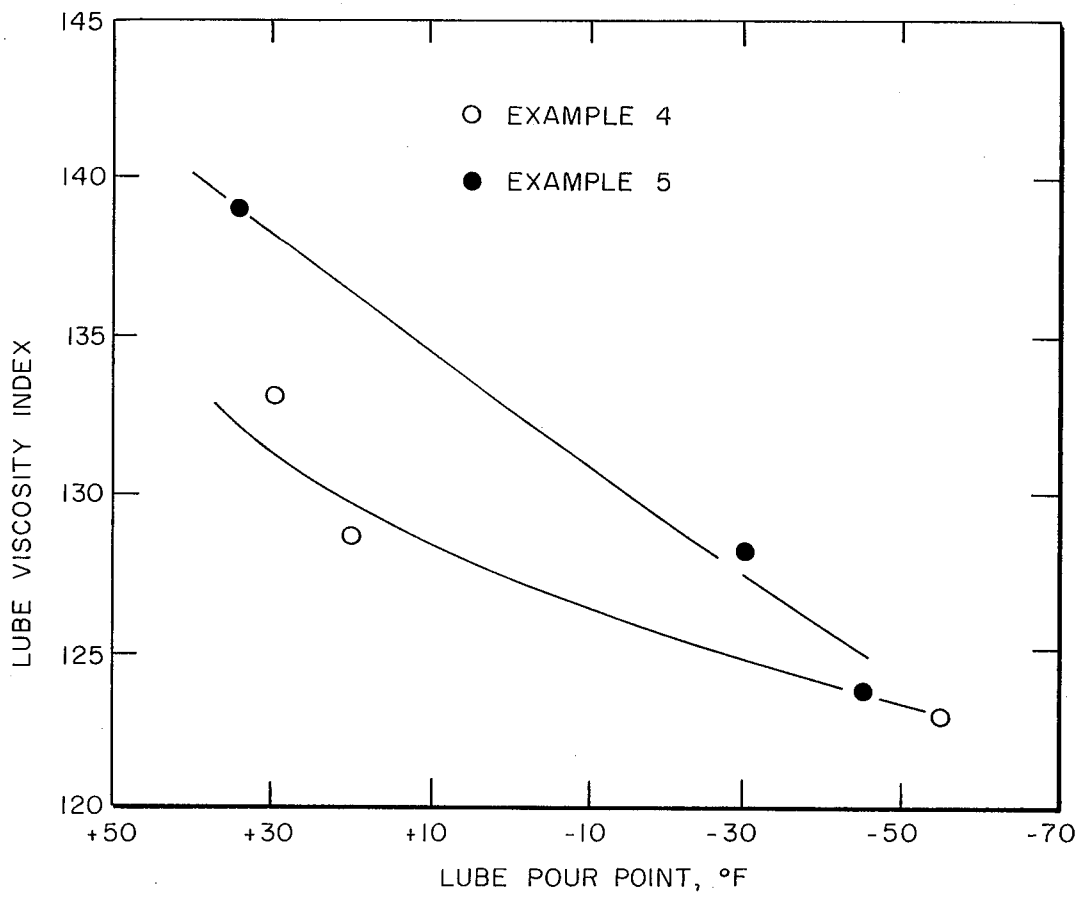
Figure 6:
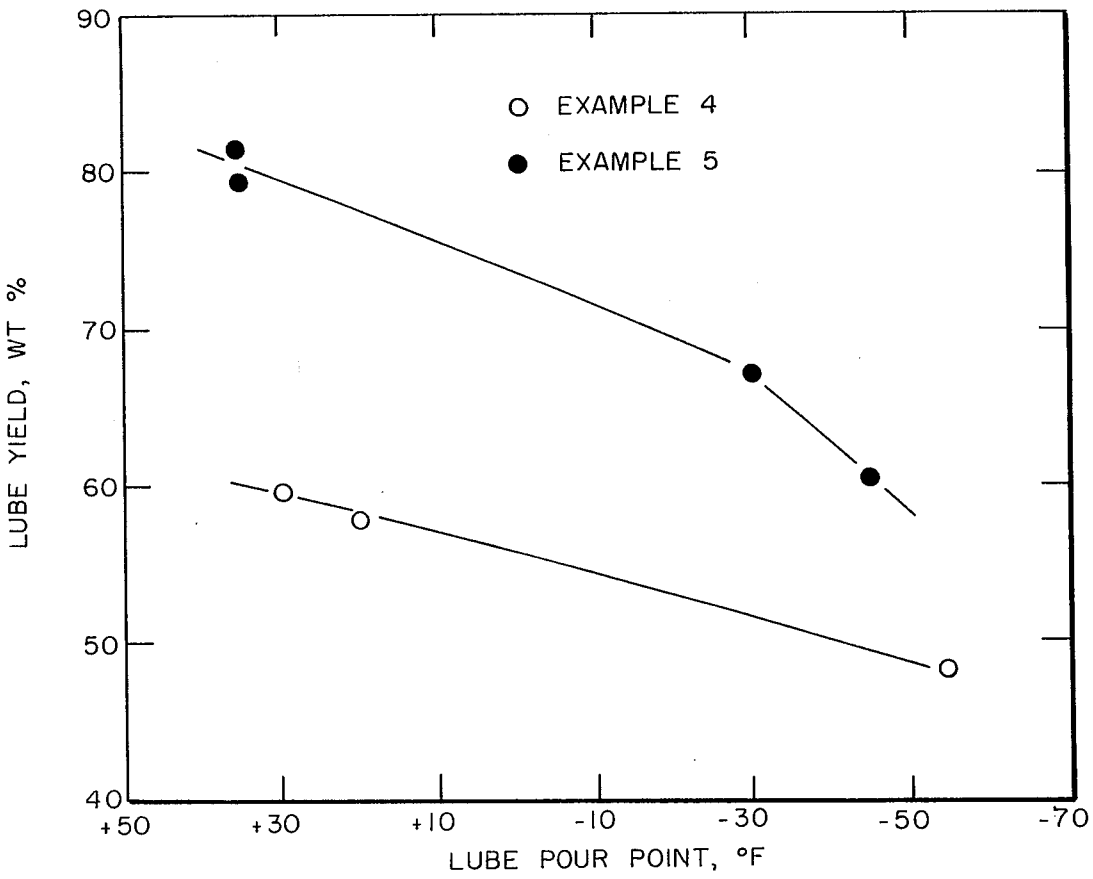

The hydroisomerized products were then catalytically dewaxed over 0.5 wt. pct. Pt/ZSM-23 to a −45° C. (−50° F.) nominal pour point at 2860 kPa (400 psig) $H_2$, 1 LHSV, 445 n.l.l.$^{-1}$ (2500 SCF/Bbl) $H_2$:oil. A dewaxing catalyst temperature of about 22° C. (40° F.) higher was needed for the higher pour point hydroisomerized product to bring it to the −45°±2.8° C. (−50°±5° F.) pour point. The results for the entire hydroisomerization/dewaxing process are shown in Table 4 below, with lube yields and VI values relative to pour point being shown in FIGS. 5 and 6.

TABLE 4

| Ex. No. | Slack Wax Hydroisomerization-Dewaxing 4 | 5 |
|---|---|---|
| Hydroisomerization | | |
| Cat. Temp., °C. (°F.) | 396 (745) | 404 (760) |
| Lube yield, 345° C.+, wt % | 78 | 55 |
| Pour point, °C. (°F.) | 49+ (120+) | 32 (90) |
| Dewaxing | | |
| Temp. °C. (°F.) | 370 (700) | 345 (850) |
| Lube Yield, 345° C.+ wt % | 49 | 60 |
| Pour Point, °C. (°F.) | −48 (−55) | −43 (−45) |
| Viscosity Index | 122.9 | 123.8 |
| SUS @ 38° C. | 194 | 176 |
| Overall Lube Yield, wt % | 38 | 33 |

EXAMPLES 6–8

These examples illustrate the comparison between catalytic dewaxing and solvent dewaxing for the dewaxing step.

The 32° C. (90° F.) hydroisomerized product of Example 5 was dewaxed to −12° C. (+10° F.) pour point by catalytic dewaxing over 0.5 wt. pct. Pt/ZSM-23 and by MEK dewaxing. The catalytic dewaxing was carried out as described in Examples 4–5 but with the temperatures shown in Table 5 below.

TABLE 5

| Ex. No. | Hydroisomerized Slack Wax Dewaxing 6 | 7 | 8 |
|---|---|---|---|
| Dewax | Pt/ZSM-23 | Pt/ZSM-23 | MEK |
| Cat. temp., °C. (°F.) | 350 (660) | 307 (585) | (1) |
| Lube yield, 345° C.+, wt pct | 57 (2) | 75 (2) | 71 |
| Pour point, °F. | +10 | +10 | +10 |
| VI | 128 (3) | 135 (3) | 140 |

Notes:
(1) 60/40 vol pct MEK/toluene, 3:1 solvent:oil, −10° C. (−15° F.) slurry temp.
(2) Interpolated from FIG. 5
(3) Interpolated from FIG. 6

EXAMPLE 9

This Example illustrates the effect of hydrotreating the hydroisomerized-dewaxed product.

The feed was a hydroisomerized-catalytically dewaxed slack wax feed produced by hydroisomerizing the slack wax of Table 3 over zeolite beta and then dewaxing the hydroisomerized product over Pt/ZSM-23 to a −20° C. −5° F. pour point. This product was then hydrotreated over Cyanamid HDN-30 catalyst ($NiMo/Al_2O_3$) under the conditions shown in Table 6 below to produce the products shown. In each case, the hydrotreatinbg was carried out at 13890 kPa (2000 psig) hydrogen pressure, 1 LHSV.

TABLE 6

| Run No. | Charge | Lube Hydrotreating 9-1 | 9-2 | 9-3 | 9-4 | 9-5 | 9-6 |
|---|---|---|---|---|---|---|---|
| HDT Temp. °C. (°F.) | — | 329 (625) | 345 (650) | 357 (675) | 370 (700) | 329 (625) | 329 (625) |
| Lube Yield, wt % 345° C.+ | | 93.8 | 92.1 | 89.0 | 83.6 | 94.1 | 92.6 |
| HDT Oil Properties | | | | | | | |
| KV @ 40° C. | 38.3 | 38.1 | 37.1 | 33.0 | 27.8 | 37.6 | 37.0 |
| KV @ 100° C. | 6.65 | 6.72 | 6.58 | 6.16 | 5.55 | 6.65 | 6.59 |
| SUS @ 100° F. | | 195 | 190 | 169 | 143 | 192 | 190 |
| VI | 130 | 134 | 132 | 138 | 142 | 133 | 134 |

TABLE 6-continued

| Run No. | Charge | Lube Hydrotreating 9-1 | 9-2 | 9-3 | 9-4 | 9-5 | 9-6 |
|---|---|---|---|---|---|---|---|
| Pour Point, °F. | −5 | 0 | 0 | 5 | 5 | 5 | 5 |
| Aromatics, wt % | 18 | 2.9 | 2.2 | 1.5 | 1.2 | 1.0 | 0.5 |
| UV Absorbance | | | | | | | |
| @ 226 nm | — | .352 | .272 | .176 | .123 | .049 | .046 |
| @ 400 nm × $10^5$ | — | 12.0 | 24.3 | 31.2 | 25.4 | 8.3 | 7.9 |

We claim:

1. A process for producing a high viscosity index (V.I.), low pour point lubricant from a petroleum feed, which comprises:

(i) dewaxing the feed to form a paraffinic petroleum wax feed containing at least 50 weight percent paraffins, and having an initial boiling point above about 650° F., (ii) partially dewaxing the wax feed in an initial catalytic dewaxing step by contacting the feed under dewaxing conditions of elevated temperature and pressure in the presence of hydrogen at a hydrogen partial pressure from 2,000 to 10,000 kPa with a dewaxing catalyst comprising zeolite beta and a hydrogenation-dehydrogenation component, to effect a partial removal of waxy paraffinic components by isomerization of the waxy paraffinic components to relatively less waxy iso-paraffinic components, to produce partially dewaxed effluent, and (iii) subjecting the partially dewaxed effluent to a selective dewaxing operation to effect a removal of waxy components while minimizing removal of the branched chain isoparaffinic components, to produce a dewaxed lubricant product basestock having a V.I. of at least 130 and a pour point not higher than 10° F.

2. A process according to claim 1 in which the lubricant product has a V.I. of at least 140.

3. A process according to claim 1 in which the lubricant product has a pour point not higher than 5° F.

4. A process according to claim 1 in which the wax feed has a paraffin content of at least 70 weight percent.

5. A process according to claim 1 in which the wax feed has a paraffin content of at least 80 weight percent.

6. A process according to claim 4 in which the wax feed comprises slack wax.

7. A process according to claim 4 in which the wax feed comprises de-oiled wax.

8. A process according to claim 1 in which the selective dewaxing operation is a solvent dewaxing.

9. A process according to claim 8 in which wax separated during the solvent dewaxing is recycled to the partial dewaxing step.

10. A process according to claim 1 in which the zeolite beta has a silica:alumina ratio of at least 30:1.

11. A process according to claim 10 in which the hydrogenation-dehydrogenation component on the zeolite beta dewaxing catalyst comprises a noble metal.

12. A process according to claim 1 in which the conversion in the initial catalytic dewaxing step is from 20 to 60 weight percent to products boiling below 650° F.

13. A process according to claim 12 in which the conversion in the initial catalytic dewaxing step is from 30 to 50 weight percent to products boiling below 650° F.

14. A process according to claim 1 in which the partially dewaxed effluent has a pour point from 5° to 20° F.

15. A process according to claim 1 in which the selective dewaxing operation is a catalytic dewaxing over a dewaxing catalyst comprising zeolite ZSM-23.

16. A process according to claim 15 in which the dewaxing catalyst comprises a noble metal and ZSM-23.

17. A process according to claim 1 in which the selective dewaxing operation is a catalytic dewaxing over a dewaxing catalyst comprising zeolite ZSM-5.

18. A process according to claim 17 in which the dewaxing catalyst comprises a metal component having hydrogenation functionality and ZSM-5.

19. A process according to claim 18 in which the metal component is nickel.

20. A process according to claim 1 in which the dewaxed lubricant product is hydrotreated to saturate aromatics.

* * * * *